United States Patent [19]

Phillips

[11] Patent Number: 4,928,468

[45] Date of Patent: May 29, 1990

[54] BUILDING PANEL MODULE

[76] Inventor: Edward H. Phillips, 3601 Bay Shore Rd., Fort Collins, Colo. 80524

[21] Appl. No.: 279,895

[22] Filed: Dec. 5, 1988

[51] Int. Cl.[5] ..... E04B 2/62

[52] U.S. Cl. ..... 52/574; 52/588; 52/579; 109/78; 109/79

[58] Field of Search ..... 52/404, 569–574, 52/575, 576, 599, 600, 309.9, 579, 578, 580, 588; 109/78, 70, 82, 84, 79

[56] References Cited

U.S. PATENT DOCUMENTS

| | | | |
|---|---|---|---|
| 945,682 | 1/1910 | Berg . | |
| 950,832 | 3/1910 | Banning . | |
| 1,136,792 | 4/1915 | Goldsmith . | |
| 2,047,154 | 7/1936 | Pimsner | 52/588 |
| 2,076,388 | 4/1937 | Venzie | 52/588 |
| 2,323,455 | 7/1943 | Creech . | |
| 2,626,686 | 1/1953 | Creech . | |
| 2,644,552 | 7/1953 | MacDonald | 52/580 |
| 2,783,507 | 3/1957 | Medal et al. . | |
| 2,896,271 | 7/1959 | Kloote et al. . | |
| 3,070,196 | 12/1962 | Switzgable, Jr. . | |
| 3,100,556 | 8/1963 | DeRidder | 52/588 |
| 3,186,525 | 6/1965 | Gresham | 52/579 |
| 3,312,019 | 4/1967 | Faerber | 52/106 |
| 3,343,314 | 9/1967 | Smith | 52/145 |
| 3,772,835 | 11/1973 | Cox et al. | 52/79 |
| 3,802,134 | 4/1974 | McCorvey | 52/93 |
| 3,826,051 | 7/1974 | Miller et al. | 52/227 |
| 3,854,261 | 12/1974 | Frei | 52/404 |
| 3,866,376 | 2/1975 | Nelsson | 52/493 |
| 3,867,995 | 2/1975 | Sanders | 181/33 G |
| 3,946,528 | 3/1976 | Jacobson et al. | 52/79 |
| 4,037,377 | 7/1977 | Howell | 52/309.9 |
| 4,219,978 | 9/1980 | Brown | 52/125 |
| 4,321,776 | 3/1982 | Delight | 52/167 |
| 4,433,522 | 2/1984 | Yerushalmi | 52/426 |
| 4,501,101 | 2/1985 | Davis | 52/588 |
| 4,522,007 | 6/1985 | Oehlert | 52/588 |

FOREIGN PATENT DOCUMENTS

| | | | |
|---|---|---|---|
| 39316 | 10/1909 | Fed. Rep. of Germany | 109/80 |
| 499221 | 2/1920 | France . | |
| 800500 | 6/1936 | France . | |

*Primary Examiner*—John E. Murtagh

*Attorney, Agent, or Firm*—Laurence R. Brown; Alfred J. Mangels

[57] ABSTRACT

A building panel module incorporating spaced inner and outer wall surfaces of metallic sheet construction to provide both longitudinal and transverse load carrying capabilities. The module includes interior baffles that are positioned between the inner and outer wall surfaces and that overlap each other to prevent direct pathways between the inner and outer wall surfaces so that ballistic projectiles that penetrate one wall surface must also pass through the baffles before impacting the other wall surfaces, thereby reducing their energy level to such an extent that they do not penetrate the innermost wall surface. Additionally, the module incorporates one or more integral I-beam elements that provide substantial longitudinal load carrying capacity, as well as providing resistance to transversely applied loads, such as wind loads, blast loads, and the like. The I-beam elements of the modules permit the inner and outer wall surfaces to be independently positioned so that, if desired, the innermost wall surfaces can be adapted to accept longitudinal or column-type loads, while the outermost surfaces can be specifically adapted to resist transverse external loads, thereby rendering the disclosed panel elements adaptable for a wide variety of structural applications, including applications to high-security type structures and uses.

20 Claims, 8 Drawing Sheets

FIG. 3
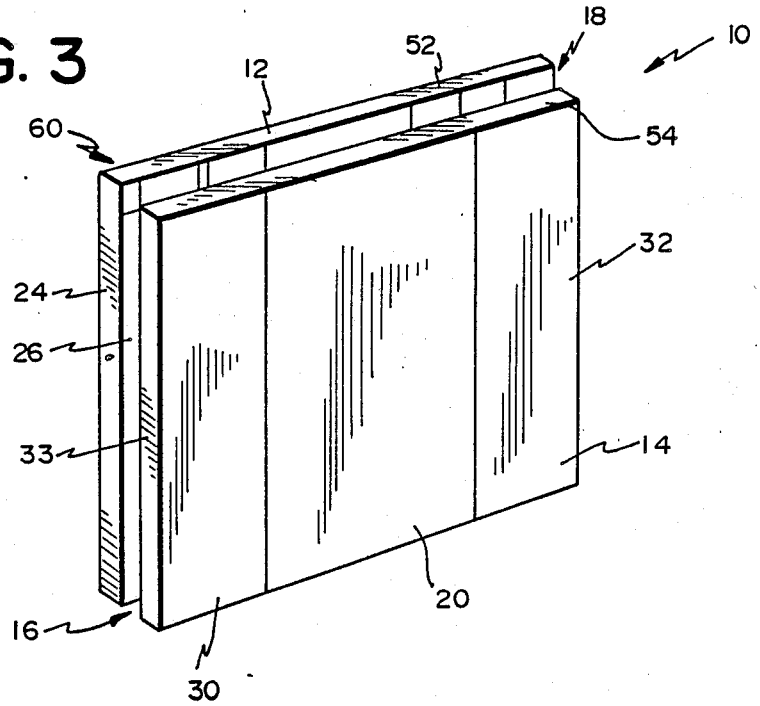
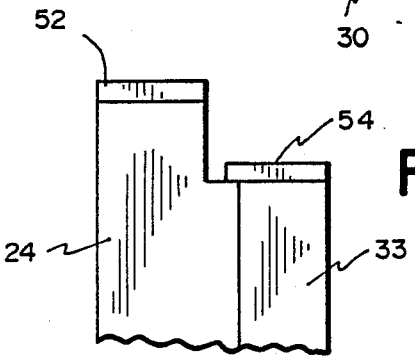
FIG. 4
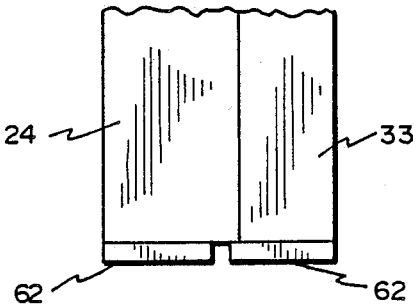
FIG. 5
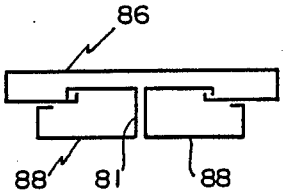
FIG. 9
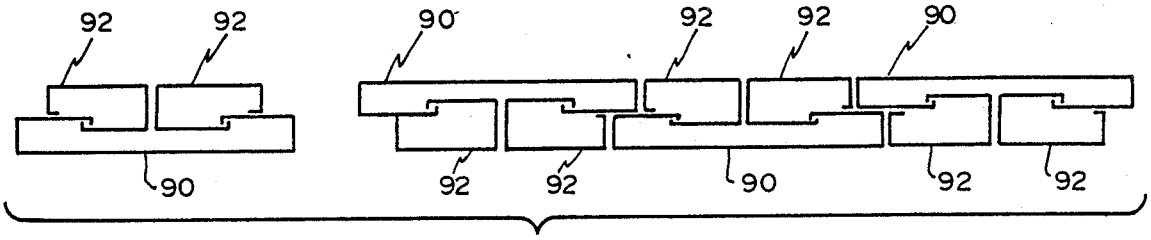
FIG. 10

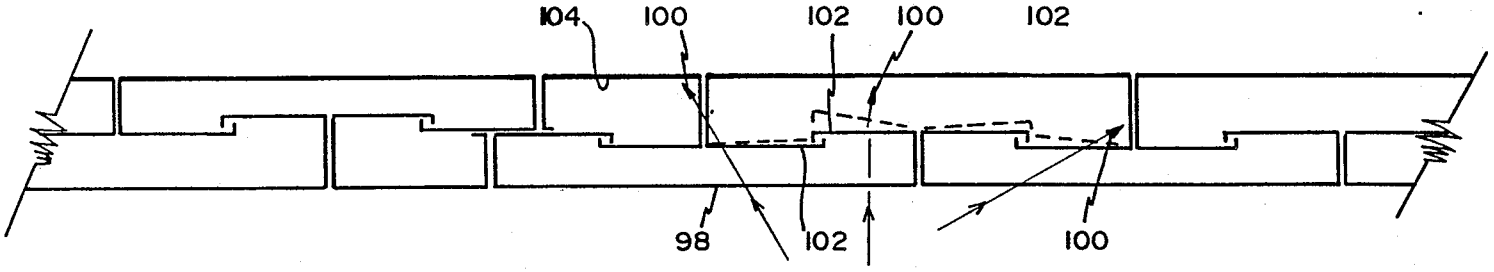
FIG. 12
FIG. 13
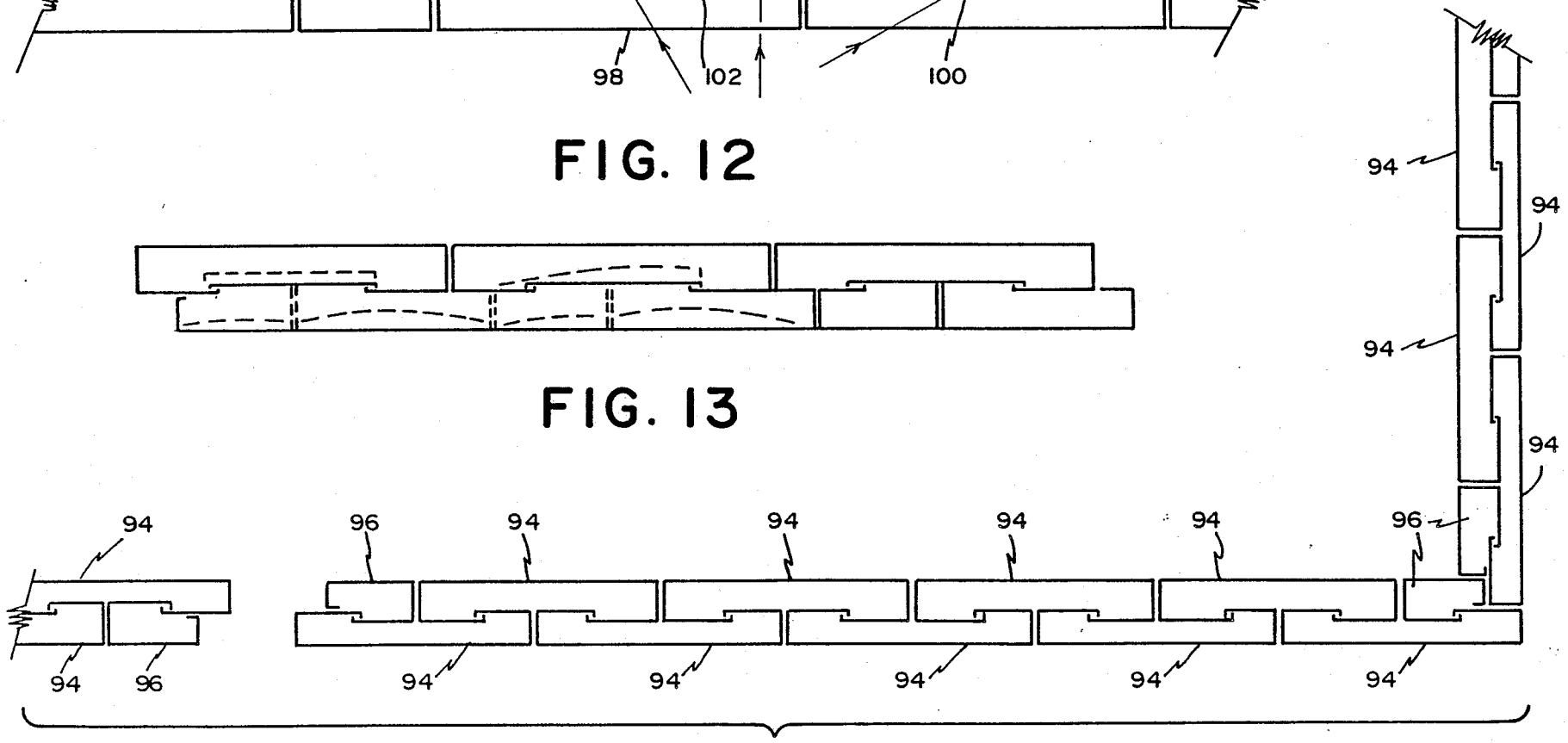
FIG. 11

BUILDING PANEL MODULE

BACKGROUND OF THE INVENTION

1. Field of the Invention

This invention relates to a building panel module structure for providing structural walls, floors, and ceilings for buildings and for parts of buildings, and more particularly to a building panel module made from metallic sheets that are bent and assembled to provide a panel module having a pair of spaced faces, a plurality of intermediate baffle members, and an integral I-beam element for increased panel rigidity and for improved resistance to longitudinal and transverse loads that are applied to the module.

2. Description of the Related Art

Metallic building panels, whether in sheet form or in module form, are generally well known. However, the use of such panels or modules is usually in conjunction with a building frame either of steel beams or of reinforced concrete construction, to which frame the panels or modules are suitably attached. Some forms of known building panels and building modules include various interiorly positioned materials for providing thermal insulation, acoustic insulation, or protection from forcible entry, and also for preventing penetration by ballistic projectiles, or for preventing collapse or rupture from blasts from explosive devices.

The known building panels in most building modules are generally cumbersome to make, are expensive, and are often quite heavy, thereby limiting their utility. Further, most of the commercially available building modules do not provide structural strength to permit a module to be both load bearing as well as functional and decorative, and that also includes sufficient strength, consistent with weight and cost considerations, to render the module applicable for construction of secure buildings or building areas in order to provide protection for both persons and property against damage or entry by terrorists or other unwanted intruders.

It is therefore an object of the present invention to provide a building panel module that provides structural-load-bearing strength as well as providing protection from unwanted entry from external sources.

It is another object of the present invention to provide a building panel module that provides resistance to penetration by ballistic projectiles.

It is a further object of the present invention to provide a building panel module that is capable of accepting longitudinal and transverse loads, to thereby eliminate the need for steel or reinforced concrete columns and beams.

It is a still further object of the present invention to provide a building panel module that incorporates inherent internal rigidity to provide protection against panel rupture or collapse caused by blasts from external explosive devices.

SUMMARY OF THE INVENTION

Briefly stated, in accordance with one aspect of the present invention, a building panel module is provided that incorporates at least three rectangular metallic plates that have faces that are arranged in parallel to define a hollow, generally rectangular building panel module for defining at least a portion of a building wall, floor, or ceiling when a plurality of such modules are assembled in side-by-side relationship or in end-to-end relationship. The module includes a pair of spaced, substantially parallel outer faces defined by a plurality of plates, at least one of the plates being symmetrical relative to a longitudinal centerline. At least two of the plates include at least one inwardly extending leg that is joined to an opposed, inwardly extending leg of an adjacent plate to define a longitudinally extending I-beam element having a planar central web member and a pair of spaced, substantially parallel flange members extending outwardly from the central web member. The I-beam element provides longitudinal stiffness to the panel modules to withstand longitudinally applied compression loads and also provides transverse strength to the panel module to withstand transversely applied bending loads on the outer face of the panel module. Each of the plates have inwardly extending legs from which baffle members extend into and within the interior spaced defined by the metallic plates, the baffle members being in overlapped relationship relative to a central transverse plane to define an inner wall that is of discontinuous, zig-zag configuration, and without gaps in the direction of a transverse centerline between the parallel plates. End caps are provided to extend across respective longitudinally spaced ends of the panel module for interconnecting respective ones of the plates to provide a unitary panel module structure that can be handled and transported as a unit for assembly with other correspondingly-shaped panel modules for defining a portion of a structural load bearing member.

BRIEF DESCRIPTION OF THE DRAWINGS

FIG. 3 is a perspective view of one form of building panel module in accordance with the present invention.

FIG. 4 is an enlarged, fragmentary side view showing one end of the building panel module shown in FIG. 3.

FIG. 5 is an enlarged, fragmentary side view of the opposite end of the building panel module shown in FIG. 3.

FIG. 9 is a transverse cross-sectional view of still another form of building panel module in accordance with the present invention.

FIG. 10 shows a plurality of building panel modules having the structure illustrated in FIG. 9, some of which have been joined in side-to-side relationship.

FIG. 11 is a transverse cross-sectional view of a portion of a wall and corner showing a further form of building panel module in accordance with the present invention.

FIG. 12 is a fragmentary cross-sectional view of a portion of a wall formed from building panel modules in accordance with the present invention and illustrating the effect of the internal structure of the modules upon the penetrability of a module by ballistic projectiles.

FIG. 13 is a fragmentary cross-sectional view similar to FIG. 12 showing the effect on a wall of an external blast or explosion.

DESCRIPTION OF THE PREFERRED EMBODIMENTS

Figure 1:
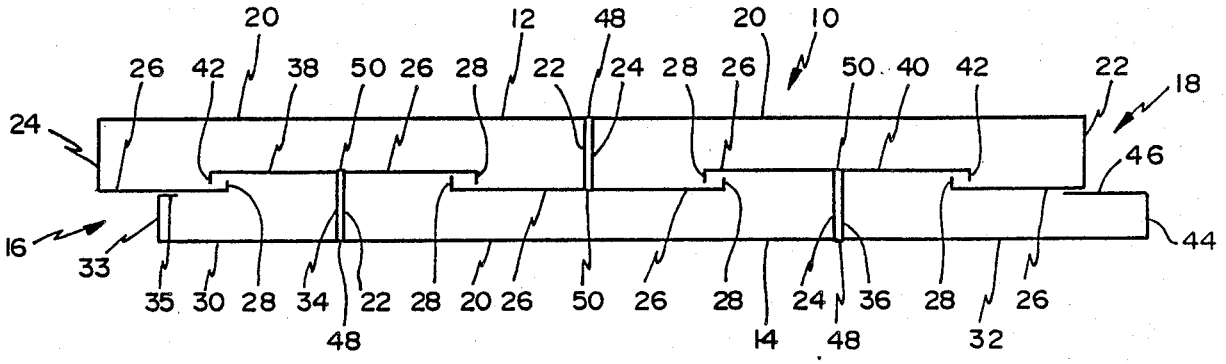
FIG. 1 is a transverse cross-sectional view taken through a building panel module in accordance with the present invention.

Referring now to the drawings, and particularly to FIG. 1 thereof, there is shown in transverse cross-section a building panel module 10 of generally rectangular form that includes a pair of spaced, generally parallel faces 12, 14, and a pair of opposed ends 16, 18 that have a stepped configuration. Module 10 is formed from five metallic sheets that have each been bent to provide a flat surface from which a plurality of legs extend inwardly into the interior of the module. The module structure shown in FIG. 1 is formed by five separate metallic elements, three of which, referred to herein as main elements, are the same both in size and in cross-sectional configuration. The remaining two metallic elements, referred to herein as end elements, are of a cross-sectional configuration similar to each other, but are of different sizes.

The three main elements that are of the same cross-section each include a planar, rectangular face panel 20 having a pair of spaced, generally parallel edges, from each of which edges a leg 22, 24 extends inwardly in a direction substantially perpendicular to face panel 20 of the respective element. Legs 22, 24 terminate at a point intermediate the inner and outer faces 12, 14 of the module, and each leg includes a similarly sized and configured baffle member 26 in the form of a substantially planar, rectangular member that extends in a direction substantially parallel to the inner and outer faces 12, 14. Baffle members 26 of a given main element lie in the same plane and extend toward each other but do not meet and do not contact each other. The cross-section of each of the main elements defines a generally U-shaped structure with an open area between baffles 26 and face panel 20. The free, innermost ends of each of baffles 26 include a flange 28 that extends inwardly toward face panel 20 and in a direction substantially perpendicular thereto.

Two of the three similarly configured main elements are placed in side-by-side relationship to define face 12 of panel module 10. The remaining main element is positioned opposite the other two, to define a part of face 14, and is oriented so that its baffles 26 at least partially overlap baffles 26 of the opposed elements, in a direction parallel to faces 12 and 14, as shown in FIG. 1, but the baffles do not contact each other. Flanges 28 on the ends of respective overlapped baffles 26 extend toward the opposed baffles, but are spaced therefrom so that the flanges contact neither the opposed baffles nor the opposed flanges, to avoid creating a direct thermal or acoustical transmission path between the opposed elements.

Positioned along each of legs 22 and 24 of the single element defining part of face 14 are a pair of end elements 30, 32, which are of similar configuration but of different size. End element 30 includes a leg 33 that is parallel to and spaced inwardly from the outermost leg 24 of the opposite main element to define a step therewith at end 16, to permit interengagement of module 10 with an end of a correspondingly-shaped module, as will be hereinafter described in greater detail. Leg 33 includes an inwardly extending flange 35 at its innermost edge adjacent opposed baffle 26, the flange extending in a direction parallel to the opposed baffle 26.

On the opposite end of the single main element from end element 30, end element 32 extends outwardly beyond leg 22 of the opposite main elements, to, again, define a step at end 18 for interengagement with an end of another, correspondingly-shaped module.

Each of end elements 30, 32 includes an inwardly extending leg 34, 36, respectively, that is of the same length as and is parallel to adjacent legs 22 and 24, and that terminates in a baffle 38, 40, respectively. Baffles 38 and 40 overlap respective adjacent baffles 26 of the opposed main elements, and each baffle 38, 40 includes an outer flange 42 that extends toward the adjacent baffle 26 but is spaced therefrom.

End element 32 is of similar configuration to end element 30 but is of a different size. Element 32 includes an inwardly extending leg 44 that is smaller in width than leg 33 of end element 30 and terminates in a plate 46 that is substantially parallel to baffles 26. Plate 46 is adapted to partially overlap endmost baffle 26 of the opposite main element but is spaced therefrom.

The longer legs 22, 24, 34, and 36 of the respective adjoining elements are parallel to each other and of equal length, and they are joined together by welds 48 along the outermost junctions of the respective legs, and by welds 50 along the innermost junctions of the respective legs. Flange 35 and plate 46 of end elements 30 and 32, respectively, are spaced from the opposed baffles 26 by a suitable sealing strip (not shown), which can be a glass fiber rope, or the like, to provide a thermal separation or break between the opposed elements. Thus, as shown in FIG. 1, panel module 10 provides two opposed faces 12, 14 that are spaced from each other, and that are not in thermally-conductive contact with each other by virtue of the spacing between the opposed baffles and associated flanges, and also the spacing at ends 16 and 18.

Welds 48 and 50 that join adjacent elements are shown and identified in FIG. 1. However, although some of the other drawing figures do not specifically show corresponding welds, it is intended that the other embodiments of the invention include such welds to join adjacent panel elements, and their absence from those other drawing figures is merely to simplify the illustrations.

Figure 2:
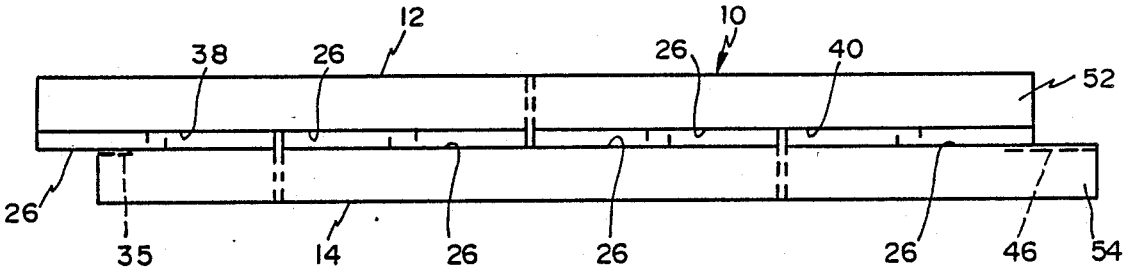
FIG. 2 is a top view of the building panel module of FIG. 1 showing an end of the panel module.

Module 10 is assembled from several of the elements hereinbefore described to provide a unitary structure by securing a pair of end caps to each of the longitudinal ends of the respective elements. Referring now to FIG. 2, there is shown a longitudinal end view of a module 10 including a pair of end caps 52, 54 at one end of the module. The end caps are each of generally rectangular form and of such a size that when secured to the ends of respective elements of the module they define a gap to permit the circulation of air into and out of the interior of the module in order that moisture does not get trapped within the module.

End cap 52 is welded to a transversely extending edge of face 12 defined by face panels 20 of two of the main elements. End cap 52 is also welded to baffles 26 of the opposed single main element and to baffles 38 and 40 that are carried by the respective end elements 30 and 32. Similarly, end cap 54 is welded to a transversely extending edge of face 14 of module 10 defined by face panel 20 of the single main element and by the respective faces of end elements 30 and 32, and it is also welded to the laterally outermost ones of baffles 26 of the opposed main elements. Consequently, end caps 52 and 54 provide interconnections between the respective elements to provide a rigid, unitary module that can be readily handled and transported, and that can be assembled with similarly configured modules, as will hereinafter be explained. Additionally, similar end caps can be provided at the opposite longitudinal end of module 10 to provide additional rigidity. Referring once again to FIG. 1, the respective welds 48 and 50 that join together the adjacent legs of adjoining elements provide a rigid connection between the adjoining elements, and the resulting connection defines an I-beam at each such welded element junction. For example, the joining together of legs 22 and 24 adjacent face 12 define the web portion of one I-beam, while the flange portions of the I-beam are defined by the respective baffles 26 at the innermost end of the web, and by the rectangular face panels 20 at the opposite, outermost end of the web. Further, as is apparent from FIG. 1, two additional such I-beam members are provided by the joinder of legs 22 and 34 and of legs 24 and 36 adjacent face 14 of the configuration illustrated.

The several internal, integral I-beam elements forming part of module 10 provide considerably increased strength for the resulting building panel module, both in a longitudinal direction of the module, in which the respective I-beam elements function as column members, as well as in a direction toward faces 12 and 14, wherein loads are applied against the outer faces 12 or 14 of the building panel modules, and in which the loads sustained by the I-beam elements are bending or flexural loads.

By virtue of the I-beam elements that are incorporated into the building panel module as integral parts of the panel module structure, the modules of the present invention are capable of withstanding heavy loads, while being of relatively light weight as compared with concrete building panel modules of comparable strength. Thus, when building modules of the type illustrated in FIG. 1 are used to define building walls, the respective I-beam elements provide the capability of carrying both floor and roof loads, for a floor or roof above the module, as well as considerable resistance to inward or outward bending or deflection of the panel.

The strength attributes of the illustrated module make it eminently suitable for use in various types of building structures, whether to define complete buildings, individual rooms, or individual components of rooms. In that regard, the illustrated panel module construction is suitable for general construction purposes, but its inherent strength attributes also render it particularly suitable for a number of other building uses. For example, when face 14 is part of the outside wall of a structure, the inherent strength and rigidity of the associated two I-beam elements provides considerable resistance to inward deflection of face 14 that might be caused by externally applied loads resulting from attempts at forced entry by intruders, and even to the point of withstanding blast forces resulting from the detonation adjacent face 14 of explosives that might be used by terrorists or others to gain entry to a building constructed of such modules.

The building panel module illustrated in FIG. 1 is adaptable to a wide variety of applications. First of all, because of the interior space that is provided, suitable thermal and acoustical insulation materials can be positioned within the interior of the module to provide desired heat and sound transmission characteristics. The interior space within the module also permits the routing of utility ducts for mechanical, electrical, and heating and ventilating systems. Further, modules can be provided with framed openings for doors, windows, vents, or other uses.

Figure 27:
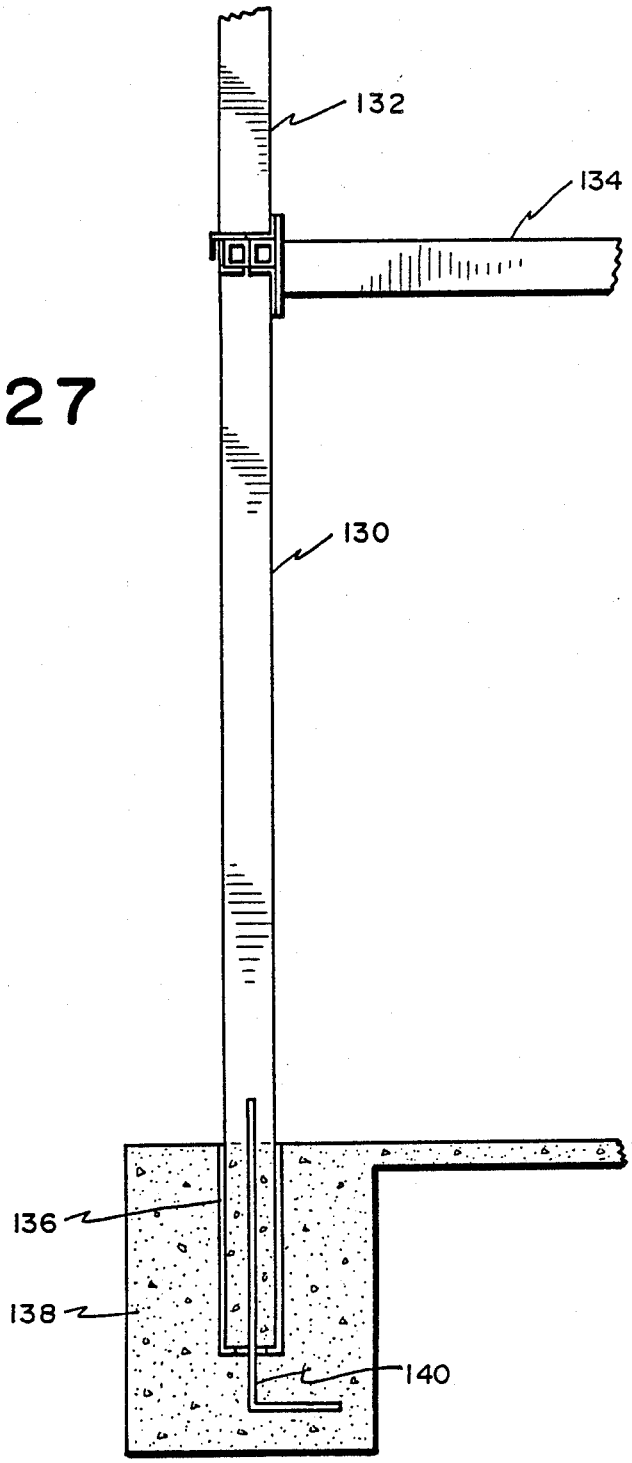
FIG. 27 is a fragmentary, vertical cross-sectional view of a wall of a two-story building constructed from building panel modules in accordance with the present invention.

Referring now to FIGS. 3, 4, and 5, there is shown in FIG. 3 a perspective view of a building panel module 10 in accordance with the present invention, the module including longitudinally extending steps along each of longitudinal sides 16 and 18 of the module, and also a step at the topmost end 60 of the module. The step at the top of the module permits it to be utilized as an integral part of a building structure, to receive a load from a floor or a roof, such as is shown generally in FIG. 27, illustrating a two-story building constructed using building panel modules in accordance with the present invention.

FIGS. 4 and 5 show the arrangement of the end caps both at the top end of the module of FIG. 3 as well as at the bottom end. In that regard, the structure illustrated in FIG. 4 is applicable at the top end of a module intended to form a vertical wall for a structure, and that is intended to carry a load transmitted from a separate module that extends generally perpendicularly to face 14 of such a wall module. The wall module would include a bottom end of the type illustrated in FIG. 5, including two end caps 62 that are spaced from each other in a front to back direction of the module to, again, permit circulation of air and thereby prevent the buildup of moisture within the module. End caps 62 could rest on a suitable foundation (not shown) and can lie in the same plane.

If the building modules hereinabove described are intended for use as floors or as ceiling panels, each of the longitudinal ends of the module can have the step construction illustrated in FIG. 4 to permit interengagement of the floor or ceiling panels with wall panels or with other floor and ceiling panels.

When the module in accordance with the present invention is used as a vertically positioned wall, in accordance with the structure illustrated in FIG. 3, the module can be tailored for particular loads and uses. In that regard, because the end caps are offset from each other, when face 12 defines an exterior surface the innermost end cap 54 as shown in FIGS. 3 and 4 can accept vertical or longitudinally directed loads, from floors, ceilings, or wall panels positioned above that panel. Thus, by appropriately sizing the web and flange portions of the I-beam elements that lie adjacent the interior surface 14, the module can be adapted to withstand particular compression, or longitudinally directed, loads. Further, the elements that define the innermost surface 14 of the module would receive the floor and compressive loads while the elements that define the outermost surface 12 of the module are not significantly loaded in a longitudinal direction. Therefore, the inner and outer elements of the module can be independent of each other from a load-carrying standpoint, and by suitably configuring the parts of the several elements that make up a module a wide range of loading conditions can be accommodated, depending upon the ultimate use of the module and the loads and environmental conditions it is expected to withstand.

Figure 6:
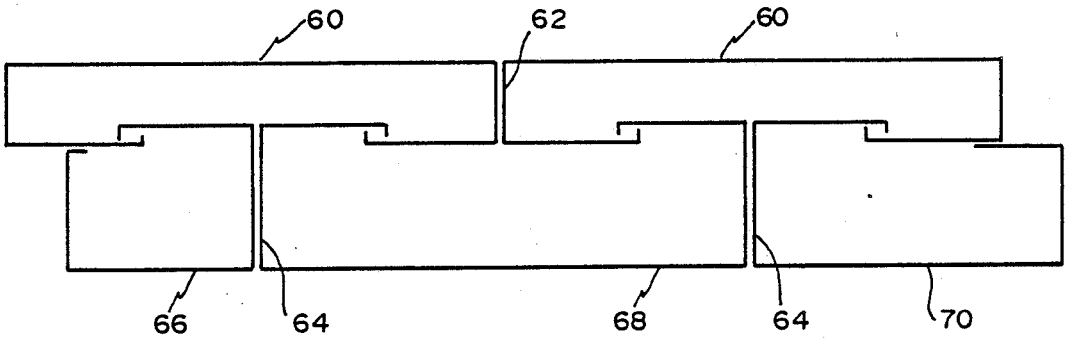
FIG. 6 is a transverse cross-sectional view of a building panel module similar to that of FIG. 1, but in which inwardly extending legs on one side of the interior of the module are longer than the legs on the opposite side of the module.

Referring now to FIG. 6, there is shown a building panel module in which two equally configured main panel elements 60 on the interior face of the module are connected along their opposed, longitudinally extending sides to define an I-beam element 62 that has a shorter web, in the front-to-back direction of the module, than do the two I-beam elements 64 defined by the three outermost panel elements 66, 68, and 70. The increased web height of I-beam elements 64 adjacent the exterior face of the module as shown in FIG. 6 provides increased resistance to bending-type loads that are applied to the outwardly-facing surface of the module. Such bending-type loads can be impact loads applied to small areas of the exterior face of the module, or they can be uniformly distributed or non-uniformly distributed loads applied over a larger area of the exterior face of the module. Further, the non-uniformly distributed loads can result from blast pressures caused by the detonation of explosives that are either spaced from or positioned adjacent to the outwardly facing surface of the module. Such resistance to bending loads renders the modules particularly suitable for applications where there is a need for high security from unwanted entry by outside intruders.

The configuration illustrated in FIG. 6 includes interior and exterior structural walls, the exterior wall defined by panel elements 66, 68, and 70 being adapted to provide resistance to external blasts, forced entry, or ballistic projectiles, and the interior wall defined by panel elements 60 being adapted to withstand both longitudinally-applied dead loads occasioned by gravity involving the weight of modules above the wall, and also live loads from contents and occupants of the structure incorporating the modules. In connection with the resistance to external blasts, the faces of the exterior panels are strengthened by virtue of the plurality of I-beam elements that are spaced along the outermost surface of the module as a result of the structure of the modules herein disclosed. Further, the additional separation of the interior and exterior walls in the FIG. 6 embodiment, as compared with the FIG. 1 embodiment, permits the incorporation of additional insulation to further improve the thermal and acoustical insulation characteristics of the structure, and also to enhance the fire resistance of the module.

One preferred form of the present invention involves modules having a six inch front-to-back depth, thereby defining a wall of six inch thickness, and made from 14 gauge, A36, 36,000 psi tensile strength steel. However, if desired, additional surface hardness can be imparted to the module by heat treating the steel in order to provide harder inner and outer surfaces, while retaining a ductile interior for the inner and outer faces of the module. The increased surface hardness provides greater resistance to penetration by ballistic projectiles, and also greater resistance to attempted forced entry by prying or battering by intruders. Additionally, if desired, and depending upon the specific conditions to which the modules will be subjected in use, the outside panel elements and the inside panel elements can each be formed from steel sheets of different gauge thicknesses, and in that regard a greater gauge thickness can be provided in the outermost panel elements to, again, provide additional resistance to penetration by ballistic projectiles and resistance to attempted forced entry by intruders. Similarly, the load carrying capacity of the inner panel elements can be increased by using steel having a greater gauge thickness, or by providing panel elements having a greater front-to-back dimension, to provide a larger I-beam section. Additionally, if the weight of a module is of particular significance and lighter weights are desired while maintaining particular strength levels, sheets made from higher strength steels can also be employed, for example, 14 gauge, A514, 100,000 psi tensile strength steel. Finally, as will be apparent to those skilled in the art, various other combinations of steel compositions, gauge thicknesses, and heat treatments can be employed, depending upon the particular loading and environmental conditions to which the module is expected to be subjected and which the module is intended to withstand.

Figure 7:
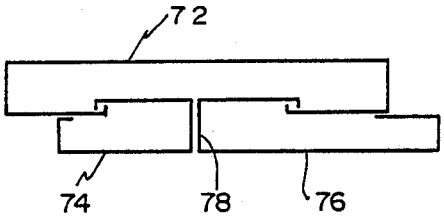
FIG. 7 is a transverse cross-sectional view of another form of building panel module in accordance with the present invention.
Figure 8:
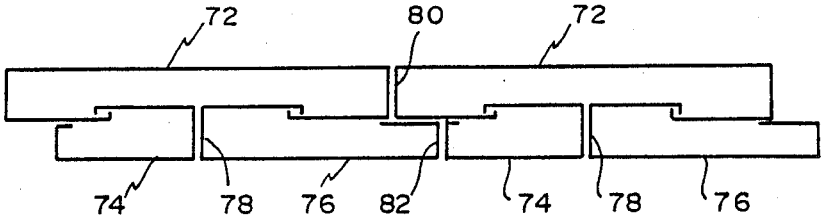
FIG. 8 is a transverse cross-sectional view of a portion of a wall or floor that is formed by joining in end-to-end relationship two building panel modules having the structure illustrated in FIG. 7.
Figure 14:
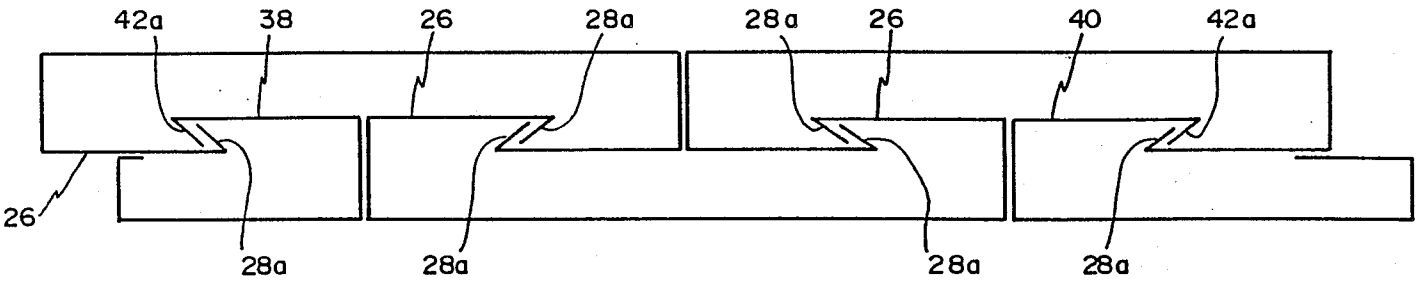
FIG. 14 is a transverse cross-sectional view of a portion of a wall made from still another form of building panel module in accordance with the present invention.

In addition to the panel module cross-sectional configurations illustrated in FIGS. 1 and 6, the fundamental beneficial attributes of the present invention can also be achieved by modules having cross-sectional configurations that are somewhat different from those shown in FIGS. 1 and 6. For example, and referring to FIGS. 7 and 8, where smaller width panels are desired for some reason, such as ease of handling or transport, modules defined by a single main element 72 on one side of the module and two side-by-side end elements 74, 76 on the other side of the module, such as shown in FIG. 7, can be employed. In that particular configuration, there is but a single I-beam element 78 incorporated in the module, and that element is preferably on the outwardly facing wall surface in applications in which high security from external forces is required. On the other hand, if high security and resistance to projectiles and forced entry are not a major consideration, the side of the panel module incorporating I-beam element 78 can be the inwardly-facing surface of the module. Moreover, when a plurality of such panels having a configuration as illustrated in FIG. 7 are assembled in side-by-side relationship to provide a wall, a floor, or a ceiling, the resulting structure is the repeating pattern as illustrated in FIG. 8, which shows two such panel modules placed side-by-side with a regular spacing between successive I-beam elements 78, the spacing being greater than the corresponding spacing in the embodiment illustrated in FIGS. 1 and 6. In that regard, at the side connection points of the respective modules, where the opposed stepped ends of the adjacent modules engage each other, various groutings or other sealing materials can be employed, such as epoxy bonding agents, together with welding at the outermost joints 80 and 82 defined by the adjacent modules.

Another form of module configuration is illustrated in FIGS. 9 and 10, which show a another form of relatively narrow width panel module also having offset or stepped longitudinally extending ends. As was the case with the embodiment illustrated in FIGS. 7 and 8, the embodiment shown in FIGS. 9 and 10 also includes only a single I-beam element, designated 84. The basic module structure includes a single, symmetrical main element 86 defining one face of the module, and two smaller, asymmetrical elements 88 defining the other face of the module. Elements 88 as shown are the same size and cross-sectional configuration. In the embodiment of FIGS. 9 and 10 the offsets or steps along the longitudinally extending sides of the modules face the same surface of the panel module, rather than facing opposite surfaces of the module as in the previously-described module embodiments. Thus, when the configuration shown in FIG. 9 is assembled with correspondingly-shaped modules, the resulting structure includes large faces 90 that alternate from the exterior surface of the wall to the interior surface of the wall, with the faces 92 of smaller elements 88, as is readily apparent from FIG. 10. Again, as was the case in connection with the module embodiment illustrated in FIGS. 7 and 8, the FIGS. 9 and 10 module embodiment also has more widely spaced I-beam elements than do the module configurations illustrated in FIGS. 1 and 6.

Referring now to FIG. 11, there is shown a wall and corner structure at the corner of a building, in which relatively large width panel modules are utilized, thereby minimizing the number of smaller, asymmetrical end members, and providing a longer and more uniform repeat pattern for the joints between adjacent modules. As shown in FIG. 11, a module includes five equally configured main elements 94 on one face and four of main elements 94 on the opposite face, the opposite face also including an end element 96 at each longitudinally extending end of the module.

The basic module structure herein disclosed can be varied by using different combinations of main elements and end elements having the cross-sectional configurations that have been hereinbefore disclosed. However, the principal feature of the invention is the presence in the wall, floor, and ceiling structure resulting from joining a plurality of modules in side-by-side relationship of periodic, parallel, longitudinally extending I-beam elements that are formed as an integral part of the structure, either on the outwardly facing wall surface or on the inwardly facing wall surface, or on both surfaces, depending upon the loading and environmental conditions to which the modules are expected to be subjected.

In addition to the substantially increased resistance to blast forces provided by the present invention, the modules also provide substantially increased resistance to penetration by ballistic projectiles. As illustrated in FIG. 12, the basic module structure involves the provision of at least three layers of steel sheet through which a bullet or other projectile must pass. In that regard, it has been found that the first steel layer 98 through which the bullet passes strips off the outer jacket of the bullet, and the remaining lead projectile 100 is deformed by impact with the second steel layer 102, which is defined by the baffles hereinbefore described. The baffles either themselves deflect inwardly as a result of impact by the projectile, as shown by the dashed lines in FIG. 12, thereby absorbing part of the kinetic energy of the projectile and reducing the energy level and also the velocity of the projectile, or the baffles bend inwardly slightly until they touch another, adjacent but offset baffle to, again, reduce the energy level of the projectile, thereby preventing the projectile from passing completely through the module. The leftmost projectile 100 in FIG. 12 follows a path that includes four layers of steel through which the projectile must pass before it reaches the innermost surface. Further, the overlapping of the baffles and the overlapping of the flanges at the outer ends of the baffles insures that two layers of steel must be penetrated, no matter what the angular relationship between the surface of the wall and the path of the projectile, before the projectile reaches the innermost surface 104 of the wall.

FIG. 13 shows the effect of the integral I-beam structure of a wall formed from modules in accordance with the present invention on the ability of the wall to resist forces caused by external blasts of explosive materials adjacent a face of the module. The dashed lines represent a deflected position of the parts of the wall after an explosion on one side. The illustrated structure is considerably more resistant to such loads than a panel or module that does not include the integral I-beam elements that are provided by a module formed in accordance with the present invention.

Figure 16:
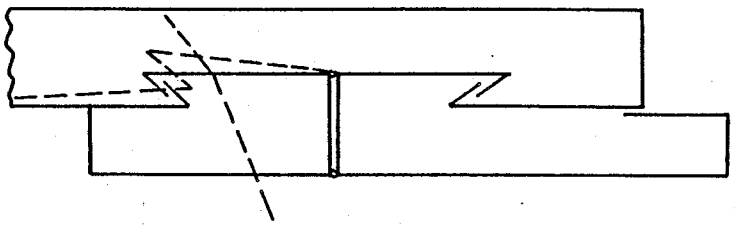
FIG. 16 is a transverse cross-sectional view similar to FIG. 15 showing the effect of the panel structure on an attempted penetration of the panel by a ballistic projectile.
Figure 15:
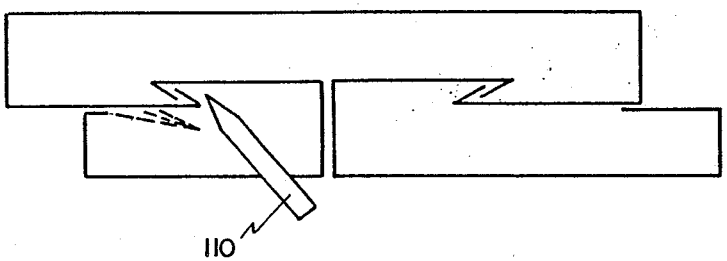
FIG. 15 is a transverse cross-sectional view of a panel module embodying the basic panel structure illustrated in FIG. 14 and showing the effect of the panel structure on an attempted forced entry through the panel by using a pry bar.
Figure 17:
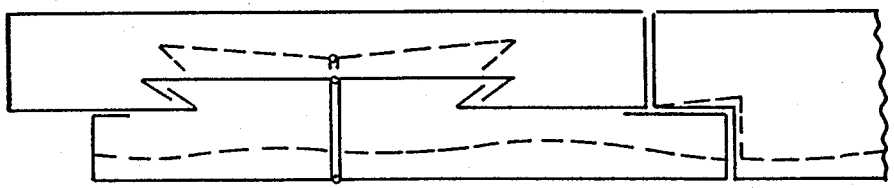
FIG. 17 is a transverse cross-sectional view similar to FIGS. 15 and 16 showing the effect of the panel structure on an attempted penetration of the panel by an explosive blast.
Figure 19:
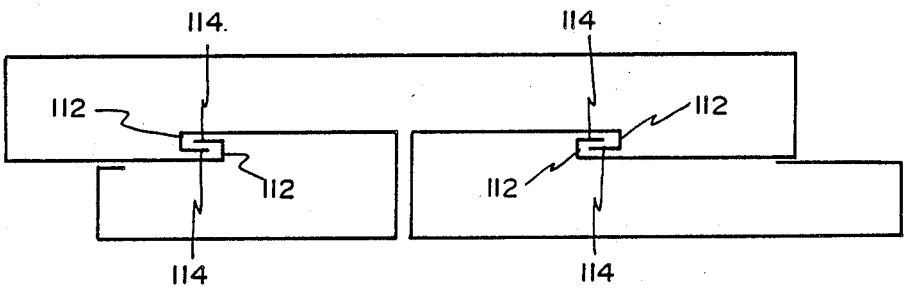
FIG. 19 is a transverse cross-sectional view of a further form of panel module structure in accordance with the present invention.

Referring now to FIGS. 14 through 17, there is shown another module embodiment of the present invention, having substantially the same configuration a the module shown in FIG. 1 but wherein the flanges 28*a* and 42*a* at the innermost ends of the respective baffles 26, 38, and 40 are each disposed at an acute angle to the transverse centerline of the module cross section. The module modification shown provides added resistance to attempts to penetrate the module by prying the baffles apart, such as by using a pry bar 110 as shown in FIG. 15. Further, the angular orientation of the flanges also causes opposed baffles to interengage and to act as a unitary barrier when either of the baffles is deflected, either inwardly or outwardly, as is shown in FIGS. 16 and 17, which illustrate the effect on such a module structure of a ballistic projectile and an external explosion, respectively.

Figure 18:
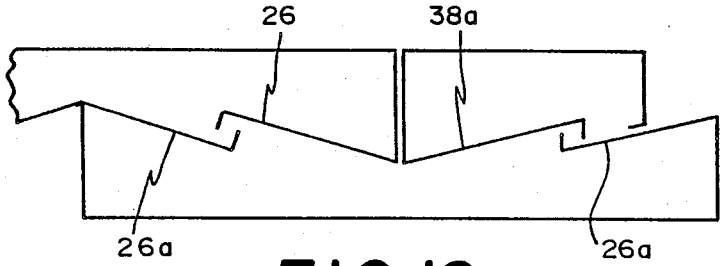
FIG. 18 is a transverse cross-sectional view of another form of panel module structure in accordance with the present invention.

FIG. 18 shows still another form of module in accordance with the present invention wherein the baffles are not parallel to the module faces, but are inclined thereto at an acute angle to further serve to deflect ballistic projectiles that penetrate an exterior face of the module.

Other forms of panel element configurations that incorporate integral I-beam elements are shown in FIGS. 19 through 22. In the FIG. 19 structure, which is similar in cross section to the embodiment of FIG. 7, the flanges 112 at the innermost edges of the baffles carry end flanges 114 that are oriented to extend toward the opposed flanges 112 and in a direction substantially parallel to the baffles. The resulting structure provides an interlocking-type of structure but without contact between the respective baffles, flanges, and end flanges, to avoid a direct thermal or acoustical transmission path.

Figure 20:
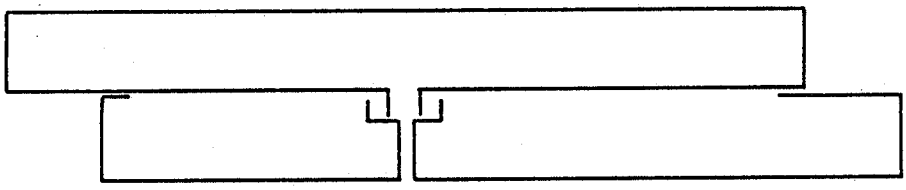
FIG. 20 is a transverse cross-sectional view of still another form of panel module in accordance with the present invention.
Figure 21:
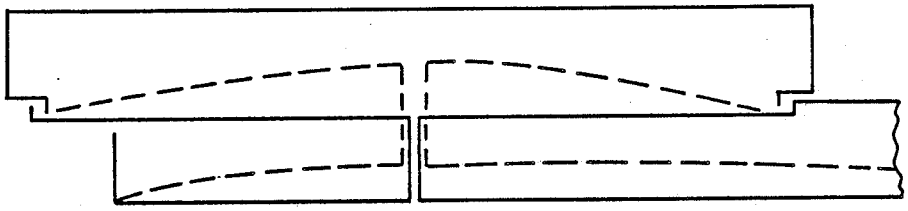
FIGS. 21 and 22 show cross-sectional views of panel modules having differently shaped baffle members and the effect on the structures illustrated of an external blast or explosion.
Figure 22:
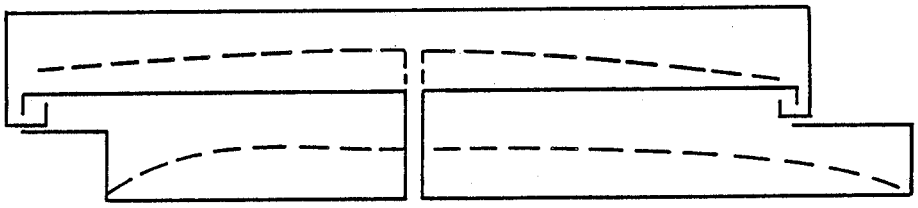

FIGS. 20, 21, and 22 show main panel elements and end panel elements each having baffles that are considerably different in transverse length, and that incorporate different flange orientations. FIGS. 21 and 22 show the effects on such structural configurations of external explosions on one face of the module.

FIGS. 23 through 26 show two further embodiments of a panel module structure that is suitable for use in applications wherein high resistance to penetration by ballistic projectiles and high resistance to blast forces is desired. The structures each incorporate an integral I-beam element. The embodiment illustrated in 23 is similar to the embodiment of FIG. 7, except that the baffles **26*b*, 38*b*, and 40*b* of FIG. 23 extend substantially coextensively with each other to, in effect, provide a module structure in which four layers of steel sheet must be penetrated, rather than the three layers of FIG. 7, in order for a projectile or other object to pass completely through the module. The reference numerals for the FIG. 23 embodiment are the same as those of the FIG. 1 embodiment for corresponding parts, except for the "b" that is used on the numerals in FIG. 23. Further, the outer ends of the respective elements 20*b*, 30*b*, and 32*b* are welded together by welds 119**.

Figure 23:
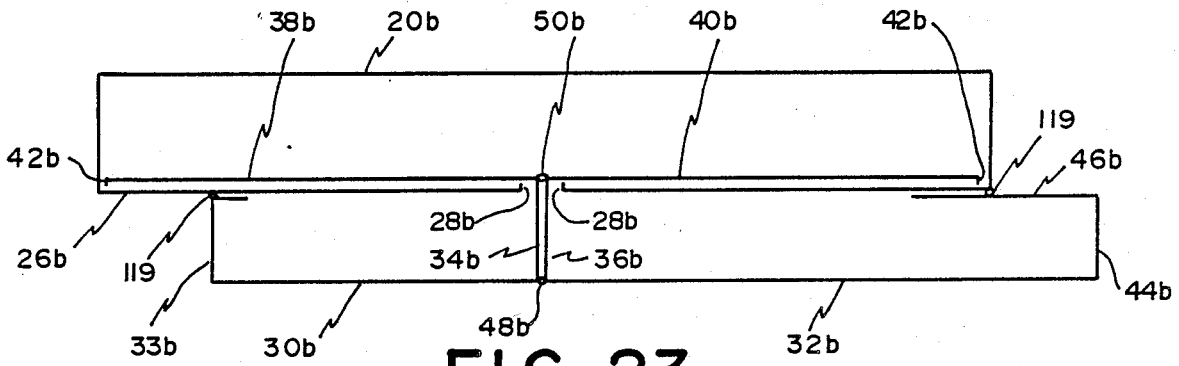
FIGS. 23 through 26 show cross-sectional views of a panel module structure that incorporates substantially coextensive baffles to provide an additional metallic layer between the outer faces of the module.
Figure 24:
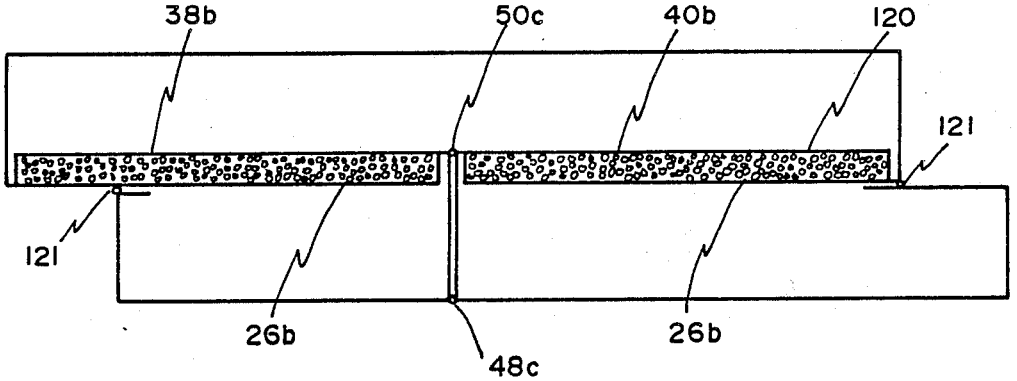

FIG. 24 shows a module structure similar to that of FIG. 23 except that the opposed baffles **26*b* and 38*b*, as well as opposed baffles 26*b* and 40*b*, are spaced from each other a greater distance and the space therebetween is completely filled with small aggregates 128**, such as loose gravel, concrete, or the like, to further slow the speed of projectiles by absorbing part of their kinetic energy as they pass through the interior of the module.

Figure 25:
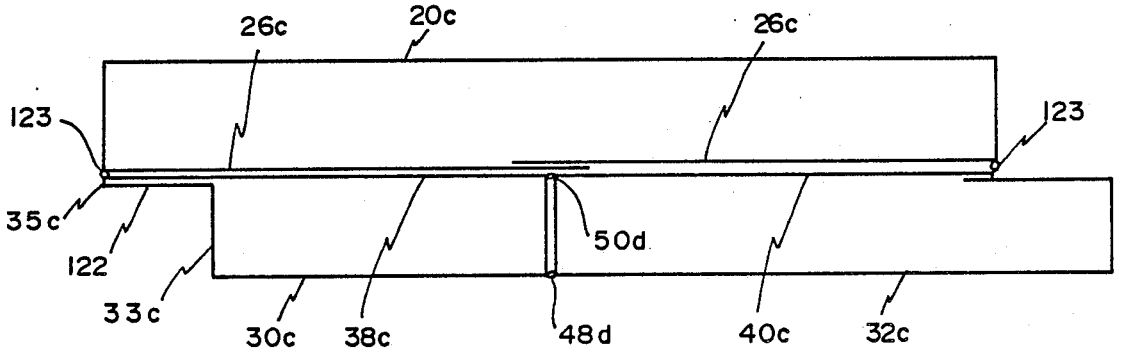

FIG. 25 is generally similar in cross section to the module of FIG. 23 except that baffles **26*c* partially overlap each other and none of the interior baffles 26*c*, 38*c*, and 40*c* includes a flange. Additionally, baffle 122 of end panel 30*c* extends outwardly, rather than inwardly as in the FIG. 23 embodiment, and it also includes a flange 35*c* that extends toward element 20*c*. The respective elements 20*c*, 30*c*, and 32*c* are welded together at their outermost ends with welds 123**.

Figure 26:
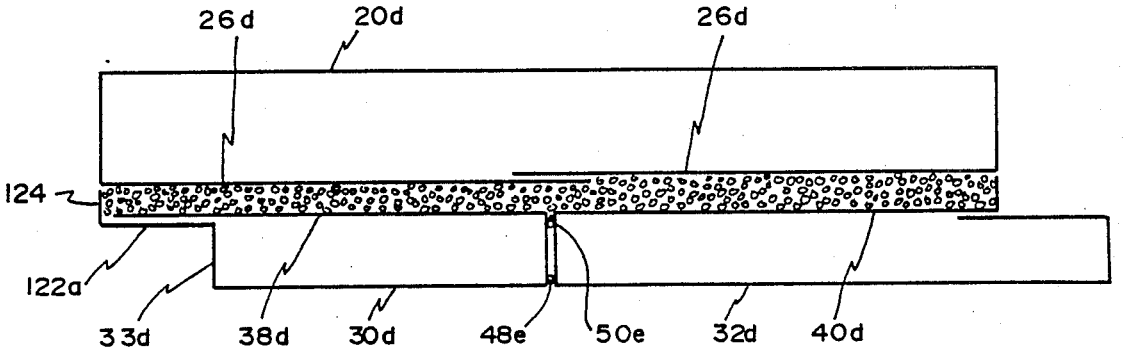

FIG. 26 shows a module having the same cross section as that of FIG. 25, except that the elements **20*d*, 30*d*, and 32*d* are spaced from each other a greater distance to permit the placement therebetween of small aggregates 128, as in the FIG. 24** embodiment.

The incorporation of the building panel modules in accordance with the present invention into a building structure is illustrated generally in FIG. 27. As there shown, a two-story structure includes two levels 130, 132 of wall modules that define the outer and inner walls of the structure and that are interconnected with a floor module 134 to define the separation between the first and second floors. The uppermost wall module 132 also carries a roof module (not shown) that can have a cross-sectional configuration in accordance with the modules hereinbefore disclosed. In addition to the interconnection of the adjacent panels of the upper and lower wall modules by welding, the opposed longitudinal ends of the wall modules can also interengage in a transverse direction of the wall by virtue of the steps formed at the respective longitudinally extending sides. Further in that regard, the uppermost end of the lower wall module can support a pair of box beams that can be welded or otherwise connected to the floor panel module, and the box beams transmit the floor loads to the first floor wall module 130 in the manner already hereinbefore described. The wall module 132 for the second story is positioned above the box beam and transmits its weight, as well as the load from the roof module, to the lower wall panel module 130. The roof module can be similar to the floor module 134 that defines the second floor.

Also evident from FIG. 27 is the construction feature whereby the wall module 130 for the first floor wall is received in a recess 136 in the foundation footing 138. Preferably, the recess has a width that is only slightly larger than the front-to-back width of the wall panel module 130, so that as the first floor wall panel module 130 is inserted into recess 136 and in such a way that the rebars 140 (only one of which is shown in FIG. 27) extend upwardly into the interior of wall module 130, as shown, so that wet concrete that has been placed within recess 136 flows between wall module 130 and recess 136, and also enters the interior of module 130 to a level that is substantially the same level as the upper surface of foundation footing 138. Thus, the first floor wall panel modules are securely embedded in the foundation footing, thereby providing a rigid support for the lowermost longitudinal ends of the first floor wall panel modules, thereby providing even greater resistance to penetration or collapse of the wall as a result of blast forces. Further, because the wall modules, the floor modules, and the roof modules are held together by welding, the building structure is substantially a unitized structure, thereby further increasing its strength and resistance to external loads.

Figure 28:
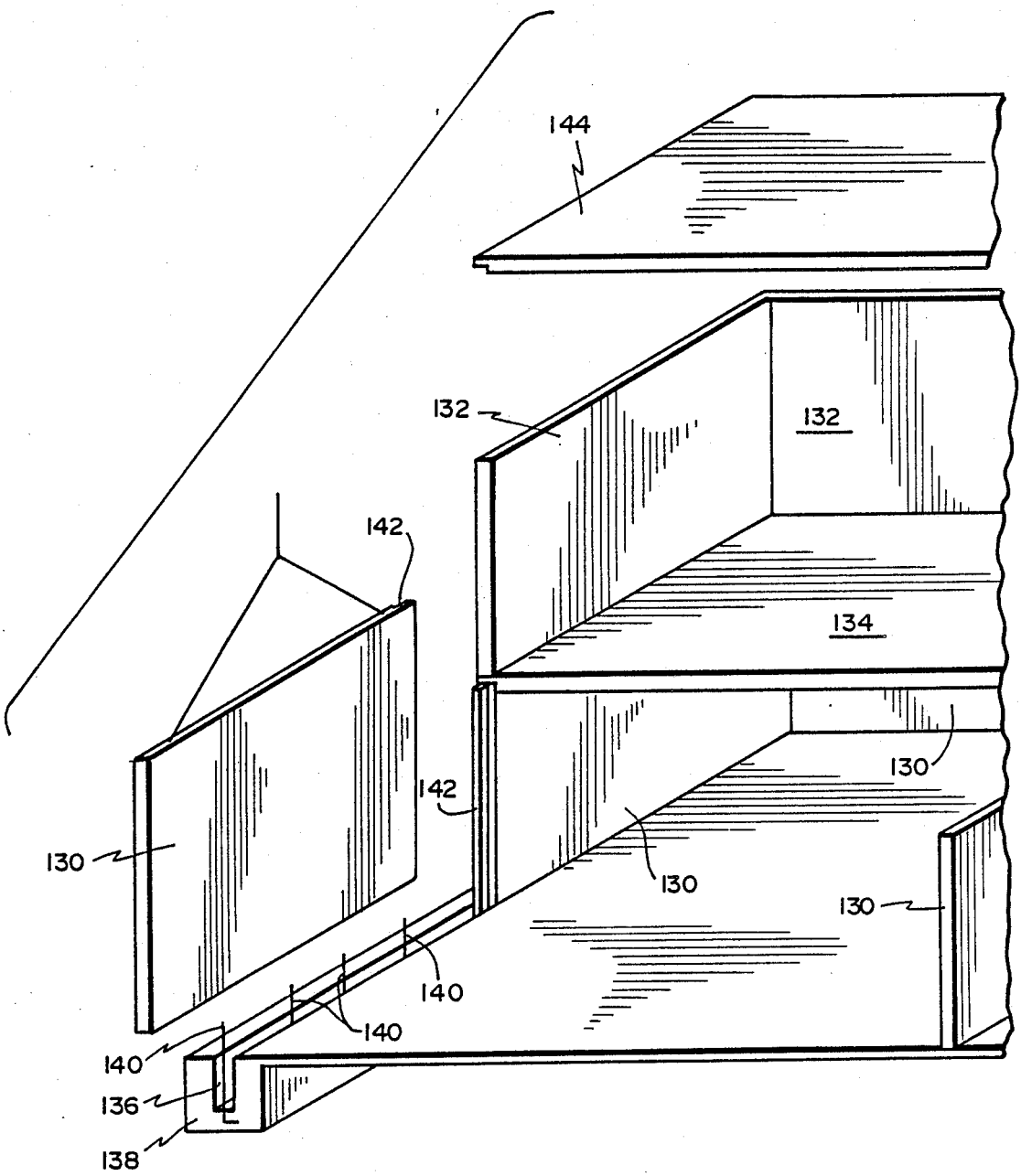
FIG. 28 is a diagrammatic perspective view of a building formed from a plurality of building panel modules in accordance with the present invention.

Buildings incorporating the modules in accordance with the present invention and as generally illustrated in FIG. 27 can be constructed as generally shown in FIG. 28, in which the same reference numerals are used as those in FIG. 27 but with the addition of roof 144. Wall modules 130, which can be of substantial length, can be lowered into position into recess 136 formed in foundation footing 138, and joined along their longitudinal edges 142, which are in overlapped relationship, to provide a strong and secure building structure that by virtue of its strength is considerably resistant to penetration from external forces.

The present invention therefore provides a significantly improved building panel module having enhanced strength, both column strength to resist longitudinal loads, as well as bending strength to resist transverse loads directed at the faces of the module. The bending loads can be either point-type loads resulting from impacts by sharp or blunt instruments, or from ballistic projectiles, as well as distributed loads, such as pressure loads resulting from blasts caused by explosives. Additionally, the modules provide resistance to fire, by virtue of their metallic nature, and they also provide buildings or parts of buildings that are better able to withstand seismic loads.

The disclosed module configurations can be used in general building construction, and they are eminently suitable for use in high-security-type structures. Furthermore, the modules can be used to provide a complete building, or, alternatively, to provide protective walls or protective rooms within existing building structures. The disclosed modules are therefore quite versatile in their application.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A generally rectangular building panel module for defining at least a portion of a building wall, floor, or ceiling when a plurality of modules are assembled, the module comprising:

(a) at least three rectangular metallic plates arranged in parallel to define a hollow, generally rectangular panel module having a pair of spaced, substantially parallel outer faces, at least one of the plates including inwardly extending legs and being symmetrical relative to a longitudinal centerline, at least two of the plates including at least one inwardly extending leg that is joined to an inwardly extending leg of an adjacent plate on the same face of the module to define a longitudinally extending I-beam element having a central web member and a pair of spaced, substantially parallel transverse end members extending outwardly from longitudinally extending edges of the central web member, the end members including an outer end member defining a part of a panel module outer face and an inner end member spaced inwardly from each of the panel module faces, the inner end members each defining first baffle members positioned within the interior of the panel module, the I-beam element providing longitudinal stiffness to the panel module to withstand longitudinally applied compression loads and to provide transverse strength to the panel module to withstand tranversely applied bending loads;

(b) a discontinuous intermediate inner wall positioned between the outer faces, the inner wall defined by respective ones of the first baffle members and by transversely offset second baffle members carried by at least one end leg of each of the plates plates, the first and second baffle members being substantially planar and positioned relative to each other in overlapping relationship and spaced from each other in a transverse direction of the module to prevent direct transmission therebetween of heat and sound and to prevent unimpeded passage through the module of ballistic projectiles that penetrate one face of the module, and thereby provide resistance to passage through the module of ballistic projectiles heat, and sound; and (c) end cap means extending across respective longitudinally spaced ends of the panel module for interconnecting respective ones of the plates to provide a unitary panel module that can be handled and transported as a unit for assembly with correspondingly-shaped panel modules for defining a portion of a structural, load bearing building surface.

2. A building panel module in accordance with claim 1 wherein the module includes a pair of spaced, substantially parallel, longitudinally extending sides, each side defined by a longitudinally extending step that is adapted to be joined with a similarly configured longitudinally extending step on a side of a second panel to form a wall having a pair of opposed parallel surfaces.

3. A building panel module in accordance with claim 2 wherein the module includes a step along at least one longitudinal end.

4. A building panel module in accordance with claim 1 wherein at least one longitudinal end of the module includes a pair of spaced end caps to permit air to flow into and out of the interior of the module.

5. A building panel module in accordance with claim 1 wherein overlapped baffle members overlap each other over substantially their entire surfaces.

6. A building panel module in accordance with claim 1 wherein the baffle members include end flange members at their outermost extremities.

7. A building panel module in accordance with claim 6 wherein the end flange members extend in a direction substantially perpendicular to the outer faces of the module.

8. A building panel module in accordance with claim 6 wherein the end flange members extend in a direction that defines an acute angle with the outer faces of the module.

9. A building panel module in accordance with claim 1 wherein the module is defined by five elements, three main elements being substantially equally configured in size and cross section, and two end elements defining ends of the module and being of similar cross section but of different size relative to each other.

10. A building panel module in accordance with claim 1 wherein the module is defined by three elements, two of which define one outer face of the panel module and are of the same size and cross section.

11. A building panel module in accordance with claim 1 wherein the module is defined by five elements, three main elements of similar configuration, and two end elements each having a configuration different from the configuration of the main elements.

12. A building panel module in accordance with claim 11 wherein two of the main elements define one outer face of the module and are of equal size and configuration, and one main element is of similar configuration as the two main elements but is of a different size from the two main elements.

13. A building panel module in accordance with claim 1 wherein opposed faces of the baffle members are spaced from each other to define a longitudinally extending gap between opposed baffle members, and aggregates are positioned within the gap.

14. A building panel module in accordance with claim 7 wherein the end flange members carry end flanges that extend in a direction substantially parallel with the baffle member connected with the flange member.

15. A building panel module in accordance with claim 7 wherein the end flange members carried by at least one panel element extend toward the module outer face that is at least partially defined by that at least one panel element.

16. A building panel module in accordance with claim 7 wherein the end flange members carried by at least one panel element extend toward the module outer face that is at least partially defined by an opposite panel element.

17. A building panel module in accordance with claim 6 wherein the end flange members extend in a direction substantially perpendicular to the baffle members.

18. A building panel module in accordance with claim 6 wherein the end flange members extend in a direction that defines an acute angle with the baffle members.

19. A modular building panel element, said building panel element comprising: a pair of opposed main faces, a pair of opposed, longitudinally extending ends, and a pair of opposed, transversely extending ends, a portion of each main face defined by a first transverse end member of an I-beam member having a central web extending longitudinally of and inwardly of the panel element, the I-beam member having a second transverse end member at an inner end of the central web and positioned interiorly of the panel element, the second transverse end members of the respective I-beam members being substantially planar and positioned in overlapping relationship in a face-to-face direction of the panel element to provide resistance to penetration of the panel element, and spaced from each other in a face-to-face direction of the building panel element to prevent direct transmission of heat and sound between the panel element faces.

20. A modular building panel element in accordance with claim 18 wherein the longitudinally extending ends of the panel element are defined by a longitudinal extending step.

* * * * *